US005295881A

United States Patent [19]

Breckenfeld et al.

[11] Patent Number: 5,295,881

[45] Date of Patent: Mar. 22, 1994

[54] MARINE PROPULSION DEVICE WITH COOLANT WATER PASSAGES

[75] Inventors: Paul W. Breckenfeld, Kenosha, Wis.; George L. Broughton, Zion, Ill.

[73] Assignee: Outboard Marine Corporation, Waukegan, Ill.

[21] Appl. No.: 974,316

[22] Filed: Nov. 10, 1992

Related U.S. Application Data

[60] Continuation of Ser. No. 789,909, Nov. 12, 1991, abandoned, which is a division of Ser. No. 567,762, Aug. 15, 1990, Pat. No. 5,083,949, which is a division of Ser. No. 316,417, Feb. 27, 1984, Pat. No. 4,966,567.

[51] Int. Cl.[5] ..... B63H 21/32

[52] U.S. Cl. ..... 440/89; 123/41.01

[58] Field of Search ..... 440/88, 89, 900; 60/273, 312, 314, 689, 694, 309, 317, 319, 321, 324; 123/41.01; 181/235, 272, 275

[56] References Cited

U.S. PATENT DOCUMENTS

| | | | |
|---|---|---|---|
| 3,520,270 | 7/1970 | Miller | 440/89 |
| 4,421,490 | 12/1983 | Nakahama | 440/89 |
| 4,795,383 | 1/1989 | Binversie et al. | 440/89 |
| 4,799,905 | 1/1989 | Broughton et al. | 440/89 |
| 4,906,214 | 3/1990 | Towner | 440/89 |
| 4,940,435 | 7/1990 | Osborn et al. | 440/89 |
| 4,955,838 | 9/1990 | Wenstadt | 440/89 |

*Primary Examiner*—Matthew C. Graham
*Attorney, Agent, or Firm*—Michael, Best & Friedrich

[57] ABSTRACT

Disclosed herein is a marine propulsion device comprising an internal combustion engine including an engine block having therein a water jacket and having a lower face which includes therein a recess, a drive shaft housing connected to the lower face of the engine block, a propeller shaft rotatably supported by the drive shaft housing and adapted to support a propeller, a drive shaft extending through the drive shaft housing and including an upper end driven by the engine and a lower end drivingly connected to the propeller shaft, an exhaust housing located at least partially within the drive shaft housing and including an upper face mating with the lower face of the engine block and including therein a recess located in opposed relation to the recess in the lower face, a water passage defined by the recess in the lower face of the engine block and by the recess in the upper face of the exhaust housing, which water passage has an inlet end and an outlet end spaced horizontally from the inlet end and communicating with the water jacket, and a conduit connected to the inlet end for supplying water to the inlet end.

7 Claims, 4 Drawing Sheets

60
31
26
29
10
12
30
28
61
20
16
18
180
66
22
14
52
200
64
59
24
55
98
53
56
54
83

76
132

64
72
170
166
172
144
72
82
168
112
84
90
70
102
116
68
130
148
98
154
84
152
88
110
160
82
158
162
74
156
160
74

33
35
34
36

MARINE PROPULSION DEVICE WITH COOLANT WATER PASSAGES

Related Applications

This application is a continuation of application Ser. No. 07/789,909, filed Nov. 12, 1991, abandoned, which is a division of application Ser. No. 567,762, filed Aug. 15, 1990, now U.S. Pat. No. 5,083,949, issued Jan. 28, 1992, which, in turn, is a division of application Ser. No. 316,417, filed Feb. 27, 1989, now U.S. Pat. No. 4,966,567, issued Oct. 3, 1990.

Attention is directed to the following U.S. Pat. applications, all of which are assigned to the assignee of this application:

| U.S. Pat. No. | Filed | Inventor |
|---|---|---|
| 4,940,435 | July 10, 1990 | Osborn |
| 4,906,214 | March 6, 1990 | Towner |
| 4,799,905 | January 24, 1989 | Broughton |
| 4,795,383 | January 3, 1989 | Binversie |
| 4,955,838 | September 11, 1990 | Wenstadt. |

Attention is also directed to U.S. Breckenfeld et al. U.S. Pat. No. 4,979,918 issued Dec. 25, 1990 which is titled "Outboard Motor Vibration Isolation System," which is assigned to the assignee hereof and which was filed concurrently herewith.

BACKGROUND OF THE INVENTION

The invention relates to marine propulsion devices. The invention also relates to marine propulsion devices including a drive shaft housing which supports an engine, and an inner exhaust housing located within the drive shaft housing and connected to the engine. The invention also relates to vibration isolating and propulsion unit supporting systems for marine propulsion devices.

A typical outboard motor includes an engine, a drive shaft housing, an adaptor sandwiched between the engine and the drive shaft housing, and an inner exhaust housing connected to the lower face of the adaptor and located within the drive shaft housing.

It is known to provide an outboard motor with an idle exhaust relief system that discharges exhaust gases above the water level when the outboard motor is operating at idle or low speeds. Typically, idle exhaust gases are discharged either from the adaptor or from the drive shaft housing.

A typical outboard motor also includes a swivel bracket adapted to be mounted on the transom of a boat, and a kingpin supported by the swivel bracket for pivotal movement relative thereto about a generally vertical steering axis. The propulsion unit (the engine, the adaptor and the drive shaft housing) is mounted on the kingpin via "rubber mounts" which vibrationally isolate the propulsion unit from the kingpin. The rubber mounts are traditionally fixed directly to either the adaptor or the drive shaft housing.

Furthermore, in conventional outboard motors having V-type engines, water is pumped to the engine water jacket via a water passage defined by the lower face of the engine block and by the upper face of the adaptor. This water passage has an inlet end located forwardly of the exhaust passage, has an outlet end located rearwardly of the exhaust passage and extends around both sides of the exhaust passage.

Attention is directed to the following U.S. patents:

| Inventor | U.S. Pat. No. | Issued |
|---|---|---|
| Kiekhaefer | 2,547,128 | April 3, 1951 |
| Kiekhaefer | 2,609,782 | Sept. 9, 1952 |
| Kiekhaefer | 2,627,242 | Feb. 3, 1953 |
| Irgens, et al. | 2,740,368 | April 3, 1956 |
| Kiekhaefer | 2,911,936 | November 10, 1959 |
| Kiekhaefer | 2,916,007 | December 8, 1959 |
| Watkins | 3,002,489 | October 3, 1961 |
| Hulsebus | 3,045,423 | July 24, 1962 |
| Mohr | 3,127,866 | April 7, 1964 |
| Shimanckas | 3,148,557 | Sept. 15, 1964 |
| Larsen | 3,198,162 | August 3, 1965 |
| Gazzara | 3,282,373 | November 1, 1966 |
| Hoiby et al. | 3,296,997 | January 10, 1967 |
| Kollman | 3,310,022 | March 21, 1967 |
| Boda et al. | 3,350,879 | November 7, 1967 |
| Post | 3,358,688 | December 19, 1967 |
| Miller | 3,520,270 | July 14, 1970 |
| Kenichi | 3,552,121 | Jan. 5, 1971 |
| Tado | 3,577,952 | May 11, 1971 |
| Taipale | 3,599,594 | August 17, 1971 |
| Haft | 3,750,615 | August 7, 1973 |
| Ellingsen | 3,782,321 | January 1, 1974 |
| Miller et al. | 3,911,852 | October 14, 1975 |
| Hall | 3,934,537 | January 27, 1976 |
| Harralson et al. | 3,967,446 | July 6, 1976 |
| Pichl | 4,033,282 | July 5, 1977 |
| Maier et al. | 4,036,162 | July 19, 1977 |
| Harbert | 4,019,456 | April 26, 1977 |
| Harada | 4,145,988 | March 27, 1979 |
| Sanmi et al. | 4,303,401 | December 1, 1981 |
| Sanmi et al. | 4,354,849 | October 19, 1982 |
| Nakahama | 4,421,490 | December 20, 1983 |
| Ping, et al. | 4,452,332 | June 5, 1984 |
| Hall et al. | 4,507,092 | March 26, 1985 |
| Iijima, et al. | 4,546,848 | October 15, 1985 |
| Price | 4,589,852 | May 20, 1986 |
| Taguchi | 4,604,069 | August 5, 1986 |
| Okazaki | 4,607,723 | August 26, 1986 |
| Bergelt | 4,625,939 | December 2, 1986 |
| Freund et al. | 4,668,199 | May 26, 1987 |
| Hattori, et al. | 4,714,132 | December 22, 1987 |

Attention is also directed to the following Japanese patent applications:

| Appl. No. | Filed |
|---|---|
| 54-25059 | March 6, 1979 |
| 55-133541 | September 25, 1980 |
| 55-155500 | November 5, 1980 |
| 55-156562 | November 7, 1980 |
| 57-68908 | April 24, 1982. |

SUMMARY OF THE INVENTION

The invention provides a marine propulsion device comprising an internal combustion engine including an engine block comprising a cylinder, an idle exhaust inlet port, an idle exhaust outlet port communicating directly with the atmosphere, and an idle exhaust passage communicating between the idle exhaust inlet port and the idle exhaust outlet port, a drive shaft housing, a propeller shaft rotatably supported by the drive shaft housing and adapted to support a propeller, a drive shaft extending through the drive shaft housing and including an upper end driven by the engine and a lower end drivingly connected to the propeller shaft, and an exhaust housing located at least partially within the drive shaft housing, the exhaust housing including a main exhaust passage communicating with the exhaust outlet port, and an idle exhaust passage communicating between the main exhaust passage and the engine idle exhaust inlet port.

The invention also provides an internal combustion engine comprising an engine block including a cylinder, an exhaust outlet port communicating with the cylinder, an idle exhaust inlet port, an idle exhaust outlet port adapted to communicate directly with the atmosphere, and an idle exhaust passage communicating between the idle exhaust inlet port and the idle exhaust outlet port.

The invention also provides a marine propulsion device comprising an internal combustion engine including an engine block, a drive shaft housing, a propeller shaft rotatably supported by said drive shaft housing and adapted to support a propeller, a drive shaft extending through said drive shaft housing and including an upper end driven by said engine and a lower end drivingly connected to said propeller shaft, and a resilient mount directly connected solely to said engine block and adapted to be supported by a kingpin.

The invention also provides a marine propulsion device comprising an internal combustion engine, said engine including an engine block having a lower face, a drive shaft housing connected to said lower face of said engine block, a propeller shaft rotatably supported by said drive shaft housing and adapted to support a propeller, a drive shaft extending through said drive shaft housing and including an upper end driven by said engine and a lower end drivingly connected to said propeller shaft, and a resilient mount located entirely above said lower face of said engine block, connected to said engine block and adapted to be supported by a kingpin.

The invention also provides a marine propulsion device comprising an internal combustion engine including an engine block, a drive shaft housing, a propeller shaft rotatably supported by the drive shaft housing and adapted to support a propeller, a drive shaft extending through the drive shaft housing and including an upper end driven by the engine and a lower end drivingly connected to the propeller, and a resilient mount directly fixed to the engine block and adapted to be supported by a kingpin.

The invention also provides a marine propulsion device comprising an internal combustion engine including an engine block having therein a water jacket and having a lower face, a drive shaft housing connected to the lower face of the engine block, a propeller shaft rotatably supported by the drive shaft housing and adapted to support a propeller, a drive shaft extending through the drive shaft housing and including an upper end driven by the engine and a lower end drivingly connected to the propeller shaft, a water passage defined by the lower face of the engine block and by the upper face of the exhaust housing, the water passage having an inlet end, and an outlet end communicating with the water jacket, and means for supplying water to the inlet end.

The invention also provides a marine propulsion device comprising an internal combustion engine including an engine block comprising a cylinder, a first water jacket, a water jacket outlet port communicating with the first water jacket, and a lower face having therein an exhaust outlet port communicating with the cylinder, a drive shaft housing, a propeller shaft rotatably supported by the drive shaft housing and adapted to support a propeller, a drive shaft extending through the drive shaft housing and including an upper end driven by the engine and a lower end drivingly connected to the propeller shaft, and an exhaust housing located at least partially within the drive shaft housing so that the exhaust housing and the drive shaft housing define therebetween a second water jacket, the exhaust housing including an exhaust passage communicating with the exhaust outlet port, an upper end, a flange portion located adjacent the upper end, a first passageway extending through the flange portion and communicating with the water jacket outlet port, and a second passageway having an inlet communicating with the first passageway, and an outlet communicating with the second water jacket.

A principal feature of the invention is the provision of a marine propulsion device comprising an engine block, and an idle exhaust relief system which discharges exhaust gases directly to the atmosphere from the engine block. This provides an exhaust gas discharge point which is higher, relative to the overall propulsion unit, than prior art discharge points which are below the engine block, in either the adaptor or the drive shaft housing. This permits the propulsion unit to be shortened, i.e., permits the engine block to be closer to the water level, since it is not necessary to have the adaptor, if one is present, or the top of the drive shaft housing located above the water level in order to provide exhaust gas discharge above the water level.

Another principal feature of the invention is the provision of rubber mounts which are supported by a kingpin and which are directly connected solely to the engine block, or located entirely above the lower face of the engine block, or directly fixed to the engine block.

Another principal feature of the invention is the provision of a water passage which supplies water to the engine water jacket and which is defined by the lower face of the engine block and by the upper face of the inner exhaust housing.

Another principal feature of the invention is the provision of an inner exhaust housing including an upper end, a flange portion located adjacent the upper end, a first passageway extending through the flange portion and communicating with the water jacket outlet port in the lower face of the engine block, and a second passageway having an inlet communicating with the first passageway, and an outlet communicating with the water jacket in the drive shaft housing.

Other features and advantages of the invention will become apparent to those skilled in the art upon review of the following detailed description, claims and drawings.

DESCRIPTION OF THE DRAWINGS

FIG. 9 is a view taken along line 9—9 in FIG. 8.

Figure 1:
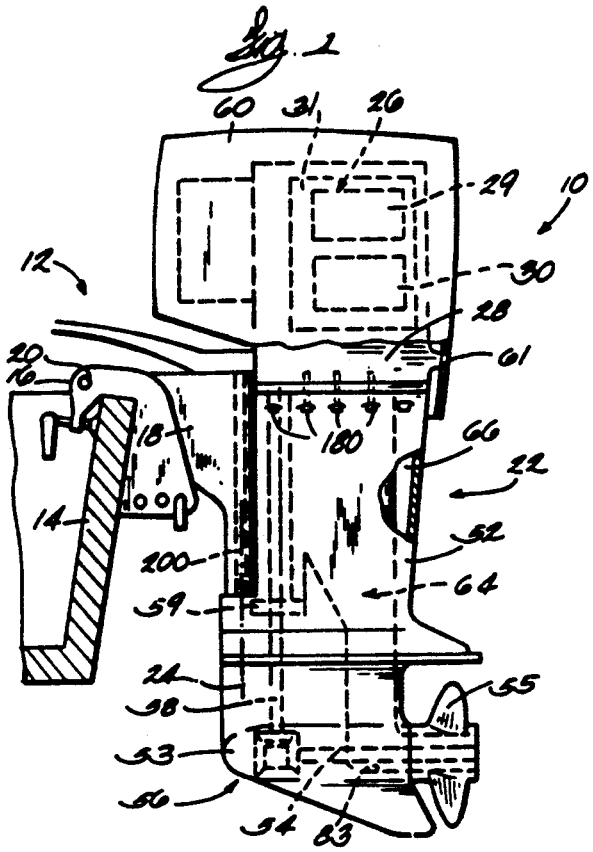
FIG. 1 is a side elevational view of a marine propulsion device embodying the invention and comprising an engine block and an exhaust housing.
Figure 15:
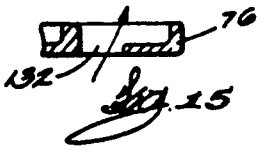
FIG. 15 is a view taken along line 15—15 in FIG. 8.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A marine propulsion device 10 embodying the invention is illustrated in the drawings. While the illustrated marine propulsion device 10 is an outboard motor, it should be understood that at least some of the advantages of the invention are obtainable with other types of marine propulsion devices, such as stern drive units.

As shown in FIG. 1, the marine propulsion device 10 comprises a mounting assembly 12 mounted on the transom 14 of a boat. While various suitable mounting assemblies can be employed, in the preferred embodiment, the mounting assembly 12 includes a transom bracket 16 fixedly mounted on the transom 14, and a swivel bracket 18 mounted on the transom bracket 16 for pivotal movement relative thereto about a generally horizontal tilt axis 20.

The marine propulsion device 10 also comprises a propulsion unit 22 mounted on the swivel bracket 18 for pivotal movement relative thereto about a generally vertical steering axis 24. The manner in which the propulsion unit 22 is mounted on the swivel bracket 18 is described in detail hereinafter.

Figure 5:
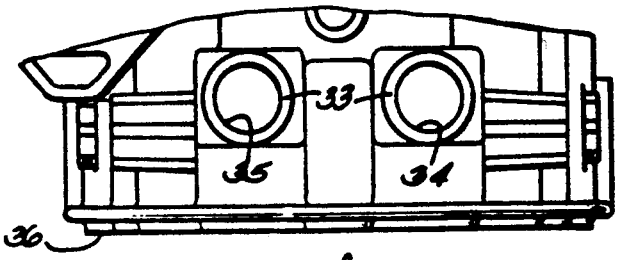
FIG. 5 is a partial rear elevational view of the engine block.
Figure 2:
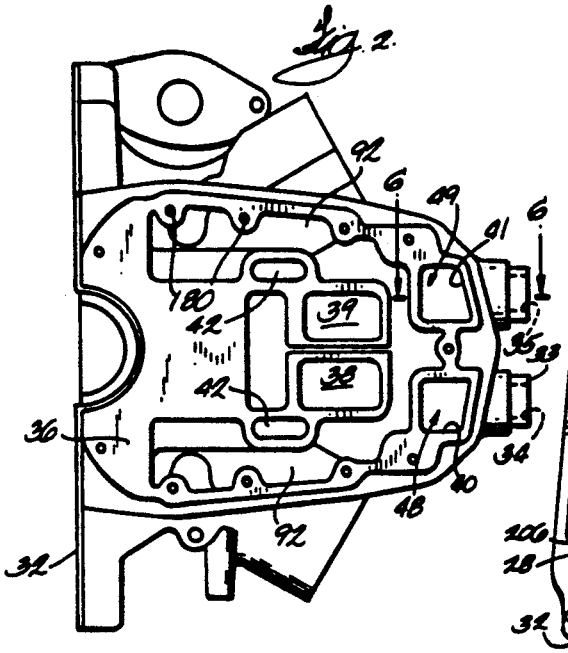
FIG. 2 is a bottom plan view of the engine block.
Figure 4:
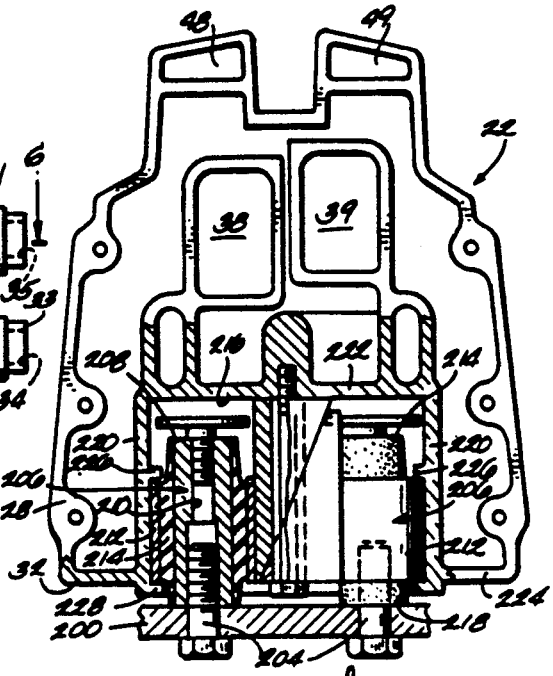
FIG. 4 is a view taken along line 4—4 in FIG. 3.
Figure 3:
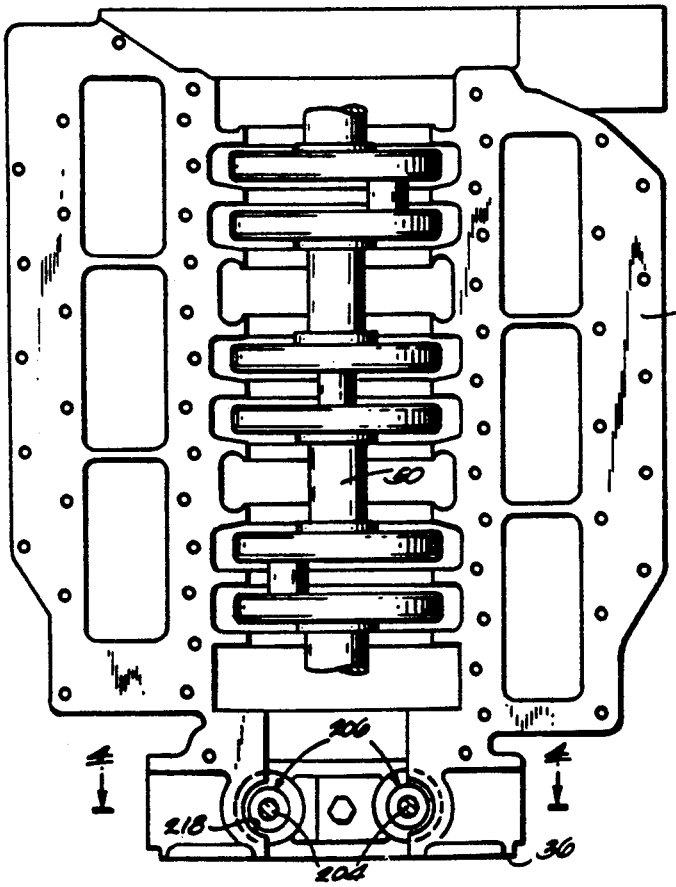
FIG. 3 is a front elevational view of the engine block.
Figure 6:
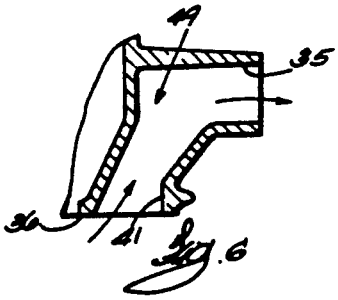
FIG. 6 is a view taken along line 6—6 in FIG. 2.

The propulsion unit 22 comprises an internal combustion engine 26 defined, in part, by an engine block 28 including at least two cylinders 29 and 30, respectively, a water jacket 31, a front face 32 (FIGS. 2–4), a rear face 33 (FIGS. 2 and 5) having therein idle exhaust outlet ports 34 and 35, and a lower face 36 (FIGS. 2, 3 and 5–7) having therein exhaust outlet ports 38 and 39 (FIG. 2) communicating with the cylinders 29 and 30, respectively, idle exhaust inlet ports 40 and 41 (FIGS. 2 and 6), and water jacket outlet ports 42 (FIG. 2) communicating with the water jacket 31. The engine block 28 also includes idle exhaust passages 48 and 49 (FIGS. 2, 4 and 6) respectively communicating between the idle exhaust inlet port 40 and the idle exhaust outlet port 34 and between the idle exhaust inlet port 41 and the idle exhaust outlet port 35. The engine block 28 at least partially supports a crankshaft 50 (FIG. 3).

Figure 8:
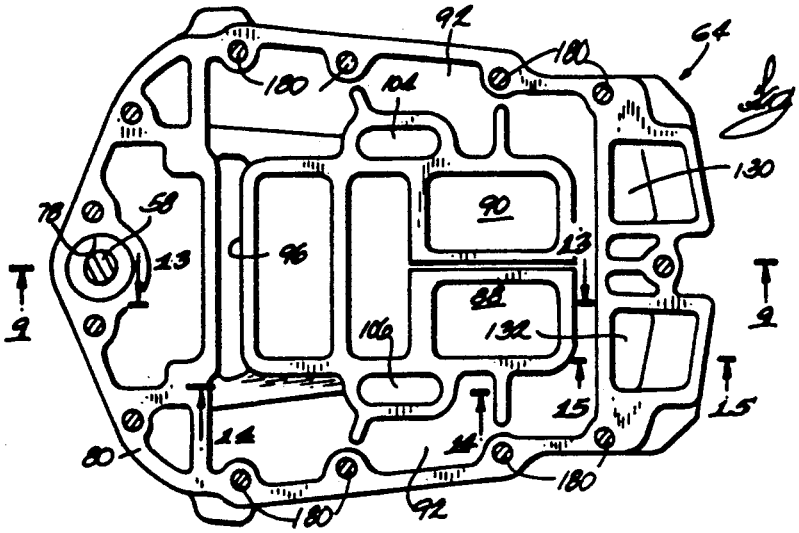
FIG. 8 is a top plan view of the exhaust housing.

The propulsion unit 22 also comprises (see FIG. 1) a drive shaft housing 52 which has upper and lower ends, and a gearcase 53 which is connected to the lower end of the drive shaft housing 52 and which rotatably supports a propeller shaft 54 carrying a propeller 55. The propeller shaft 54 is connected via a reversing transmission 56 to a drive shaft 58 (FIGS. 1 and 8) which extends through the drive shaft housing 52 and which is driven by the crankshaft 50 of the engine 26. The drive shaft 58 also extends through and drives a water pump 59 (FIG. 1), as is known in the art.

The propulsion unit 22 also comprises a cowling or cover 60 surrounding the engine 26 and the upper end of the drive shaft housing 52. The cowling 60 has therein apertures 61 (only one is shown) through which the idle exhaust outlet ports 34 and 35 communicate directly with the atmosphere.

The propulsion unit 22 also comprises (see FIGS. 1 and 7–15) an inner exhaust housing 64 which has upper and lower ends and which is located partially within the drive shaft housing 52 so that the exhaust housing 64 and the drive shaft housing 52 define therebetween (see FIG. 1) a chamber or water jacket 66. Water is supplied to the water jacket 66 in a manner described hereinafter.

The exhaust housing 64 comprises (see FIGS. 7–15) front and rear walls 68 and 70, respectively, which converge toward their lower ends, and spaced side walls 72 and 74 extending between the front and rear walls 68 and 70. The exhaust housing 64 also comprises a flange portion 16 (FIGS. 7 and 15) located adjacent the upper end of the exhaust housing 64. The flange portion 76 has therein (see FIG. 8) an aperture 78 through which the drive shaft 58 extends. The exhaust housing 64 also comprises (see FIGS. 7–9) an upper face 80 which is partially defined by the flange portion 76 and which mates with the lower face 36 of the engine block 28.

Figure 12:
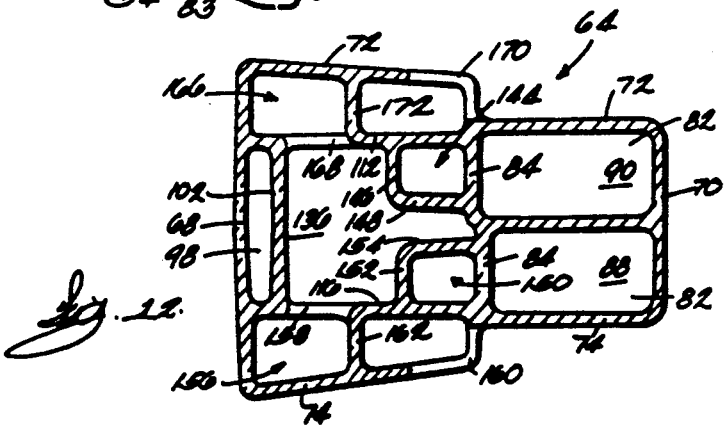
FIG. 12 is a view taken along line 12—12 in FIG. 7.
Figure 10:
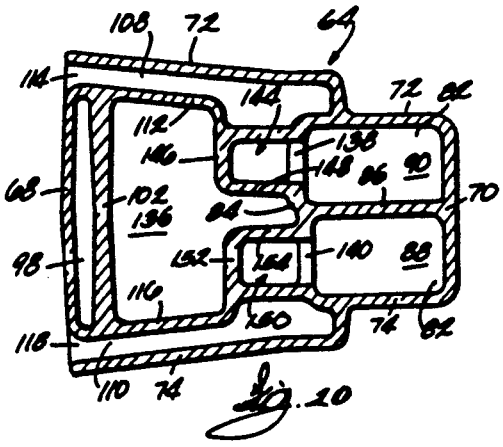
FIG. 10 is a view taken along line 10—10 in FIG. 7.
Figure 13:
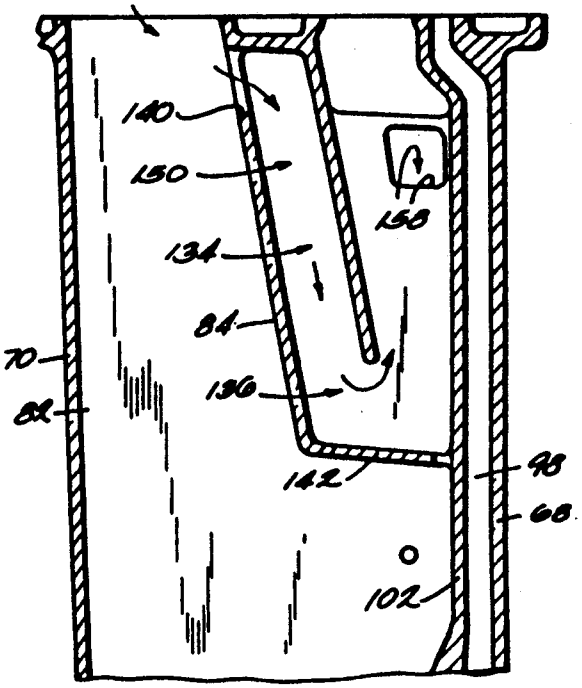
FIG. 13 is a view taken along line 13—13 in FIG. 8.
Figure 4:
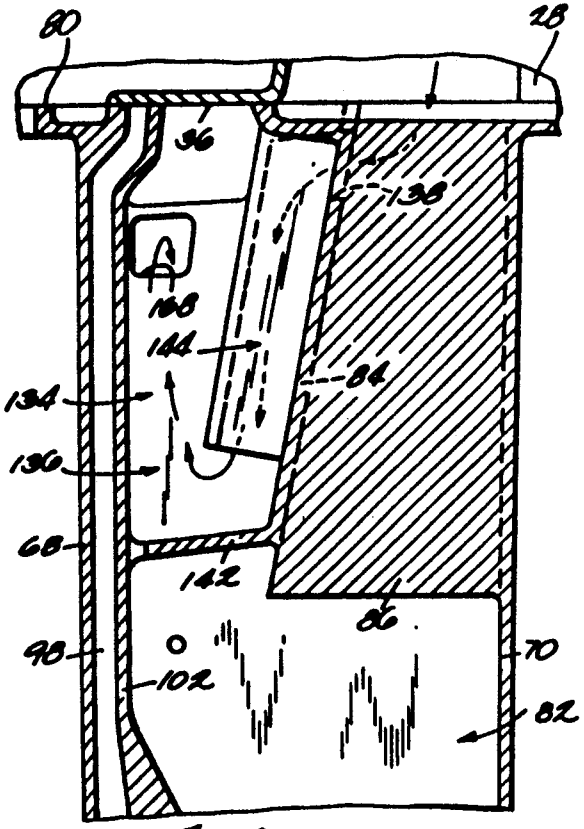

The exhaust housing 64 also comprises (see FIGS. 9 and 13) a main exhaust passage 82 having upper and lower portions, an upper end communicating with the exhaust outlet ports 38 and 39 in the lower face 36 of the engine block 28, and a lower end communicating with an exhaust passage 83 in the gearcase 53, as is known in the art. As shown in FIGS. 10 and 12, the upper portion of the main exhaust passage 82 is defined by the rear wall 70, by the side walls 72 and 74, and by a transverse wall 84 which is located intermediate the front and rear walls 68 and 70 and which extends between the side walls 72 and 74. As shown in FIGS. 9 and 13, the wall 84 extends downwardly from the upper face 80 of the exhaust housing 64 to a point above the lower end of the exhaust housing 64. The transverse wall 84 and the rear wall 70 diverge as they extend downwardly so as to form a "megaphone," as is known in the art.

In the preferred embodiment, the upper portion of the main exhaust passage 82 is bifurcated by a wall 86 (FIGS. 10 and 12) which extends between the rear wall 70 and the transverse wall 84 and which divides the main exhaust passage 82 into a first portion 88 communicating with the exhaust outlet port 39 and a second portion 90 communicating with the exhaust outlet port 38. The lower portion of the main exhaust passage 82 is defined by the front and rear walls 68 and 70 and by the side walls 72 and 74.

The exhaust housing 64 also comprises means for supplying water to the inlet end of a water passage 92 described hereinafter in greater detail. Preferably, this means includes a water intake port 94 (FIG. 7) located adjacent the lower end of the exhaust housing 64 and communicating with the outlet of the pump 59, a water outlet port 96 (FIG. 8) in the upper face 80 of the exhaust housing 64, and a water intake passage 98 (FIGS. 9, 10, 12 and 13) communicating between the water intake port 94 and the water outlet port 96 and including an upper portion and a lower portion. In the illustrated construction, the lower portion of the intake passage 98 is defined by a tube 100 (FIG. 7), and the upper portion of the intake passage 98 is defined by (see FIGS. 10 and 12) the front wall 68 and by a forward transverse wall 102 which is spaced from and generally parallel to the front wall 68 and which extends between the side walls 72 and 74.

The exhaust housing 64 also comprises water outlet passage means communicating between the water jacket outlet ports 42 and the water jacket 66. While various suitable outlet passage means can be employed, in the preferred embodiment, such means includes (see FIG. 8) water drainage or outlet passageways 104 and 106 extending through the flange portion 76 and communicating with the water jacket outlet ports 42. The water outlet passage means also includes (see FIGS. 10 and 11) a first or right, passageway 108 having an inlet communicating with and located beneath the passageway 104, and an outlet communicating with the water jacket 66. The water outlet passage means further includes (see FIGS. 7, 10, 11 and 14) a second or left passageway 110 having an inlet communicating with and located beneath the passageway 106, and an outlet communicating with the water jacket 66.

Figure 7:
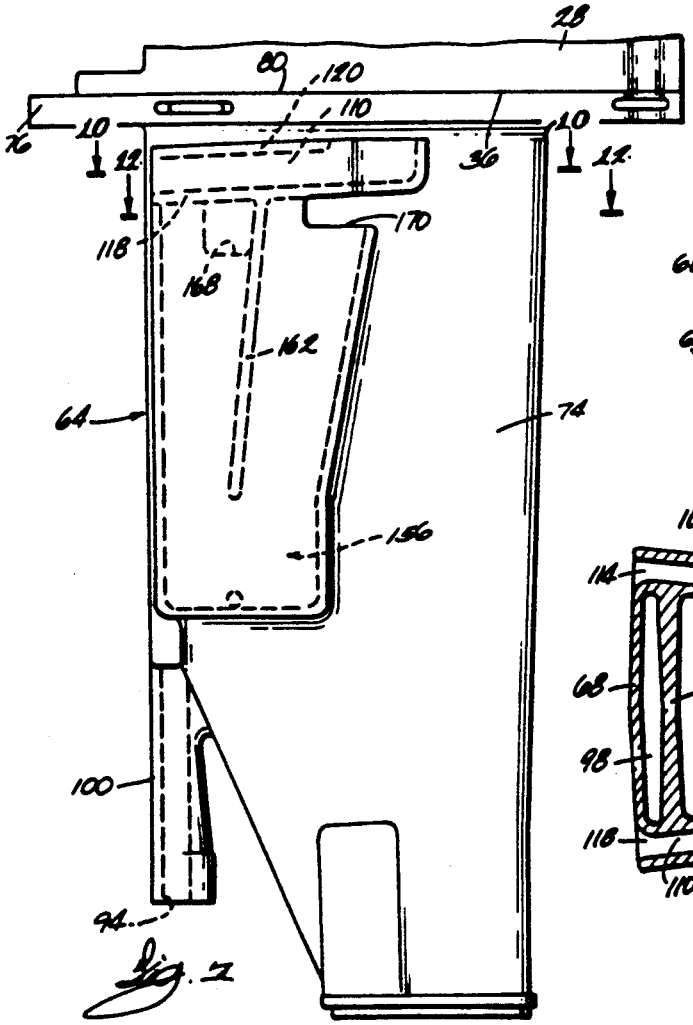
FIG. 7 is a side elevational view of the exhaust housing.
Figure 11:
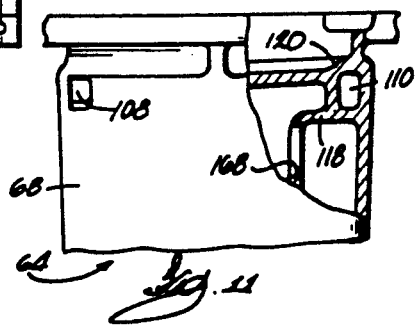
FIG. 11 is a partial front elevational view, partially broken away, of the exhaust housing.
Figure 14:
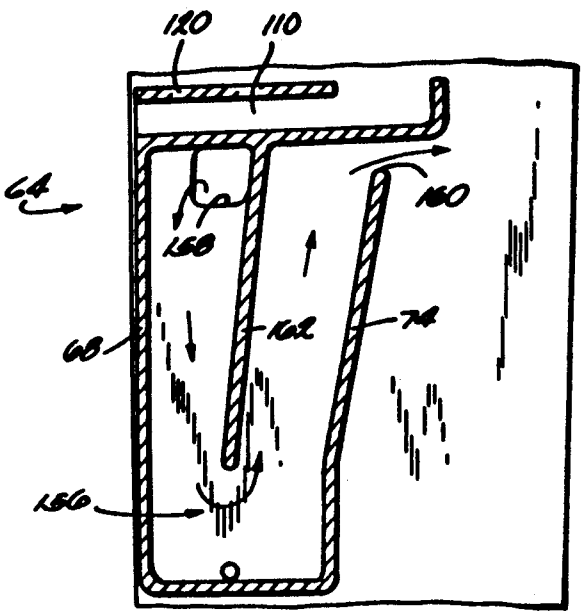
FIG. 14 is a view taken along line 14—14 in FIG. 8.

Preferably, as shown in FIGS. 7 and 14, each of the passageways 108 and 110 extends, from its inlet, forwardly and substantially horizontally, although somewhat downwardly. The outlet of each passageway 108 and 110 opens through the front wall 68 of the exhaust housing 64. The right passageway 108 is defined by (see FIG. 10) the right side wall 72, by a right inner wall 112 spaced from and generally parallel to the right side wall 72, by a horizontal wall segment 114 extending between the side wall 72 and the inner wall 112, and by an upper wall (not shown). The left passageway 110 is defined by (see FIGS. 7, 10 and 14) the left side wall 74, by a left inner wall 116 spaced from and generally parallel to the left side wall 74, by a horizontal wall segment 118 extending between the side wall 74 and the inner wall 116, and by an upper wall 120. The inner walls 112 and 116 extend between the rearward transverse wall 84 and the front wall 68.

The propulsion unit 22 also comprises the above-mentioned water passage 92 (FIGS. 2 and 8), which is defined by the lower face 36 of the engine block 28 and by the upper face 80 of the exhaust housing 64. The water passage 92 has an inlet end communicating with the water outlet port 96 and an outlet end communicating with the engine water jacket 31. In the preferred embodiment, as shown in FIG. 2, the inlet end of the water passage 92 is located forwardly of the exhaust outlets 38 and 39, the outlet end is located rearwardly of the exhaust outlets 38 and 39, and the water passage 92 extends around the exhaust outlets 38 and 39 on both sides thereof.

The marine propulsion device 10 also comprises means for affording exhaust gas relief when the engine 26 is operating at idle or low speeds. While various suitable relief means can be employed, in the illustrated construction, the relief means includes the idle exhaust inlet ports 40 and 41, the idle exhaust passages 48 and 49, the idle exhaust outlet ports 34 and 35, and idle exhaust passage means communicating between the main exhaust passage 82 and the idle exhaust inlet ports 40 and 41.

The idle exhaust passage means includes the chamber 66, and apertures 130 and 132 (FIGS. 8 and 15) extending through the flange portion 76 of the exhaust housing 64 and communicating between the chamber 66 and the idle exhaust inlet ports 40 and 41, respectively. The idle exhaust passage means also includes (see FIGS. 9 and 13) an idle exhaust passage 134 communicating with the main exhaust passage 82 and communicating with the chamber or water jacket 66 at a point above the water level (not shown) in the chamber 66.

The idle exhaust passage 134 includes an inner chamber 136 (FIGS. 9, 10, 12 and 13) communicating with the main exhaust passage portions 88 and 90 through openings 138 and 140 (FIGS. 9, 10 and 13) in the transverse wall 84. The inner chamber 136 is defined by (see FIGS. 10 and 12) the transverse wall 84, by the right inner wall 112, by the left inner wall 116, and by the forward transverse wall 102. The inner chamber 136 is also defined by (see FIGS. 9 and 13) a bottom wall 142 which extends between the lower end of the rearward transverse wall 84 and the forward transverse wall 102 and between the side walls 72 and 74.

The idle exhaust passage 134 also includes (see FIGS. 9, 10 and 12) a first or right tube 144 having an upper end communicating with the right exhaust passage portion 90 via the opening 138 and a lower end opening into the lower portion of the inner chamber 136. The right tube 144 is defined by (see FIGS. 10 and 12) a wall segment 146 extending inwardly from the right inner wall 112 and by a wall segment 148 extending rearwardly from the wall segment 146 to the transverse wall 84. The lower ends of the wall segments 146 and 148 are spaced above the bottom wall 142. The idle exhaust passage 134 also includes (see FIGS. 10, 12 and 13) a second or left tube 150 having an upper end communicating with the exhaust passage portion 88 via the opening 140 and a lower end opening into the inner chamber 136. The left tube 150 is defined by (see FIGS. 10 and 12) a wall segment 152 extending inwardly from the left inner wall 116 and by a wall segment 154 extending rearwardly from the wall segment 152 to the transverse wall 84. The lower ends of the wall segments 152 and 154 are spaced above the bottom wall 142.

The idle exhaust passage 134 also includes (see FIGS. 7, 12 and 14) a left outer chamber 156 which communicates with the inner chamber 136 via an opening 158 in the left inner wall 116 and which communicates with the atmosphere via an opening 160 in the left side wall 74. The outer chamber 156 is defined by the left inner wall 116, by the front wall 68 and by the side wall 74. The left outer chamber 156 has therein a transverse wall segment 162 which is located between the openings 158 and 160, which extends between the inner wall 116 and the side wall 74 and which terminates above the lower end of the left outer chamber 156. As a result, gases flowing from the opening 158 to the opening 160 must flow downwardly around the lower end of the transverse wall segment 162 and then upwardly to the opening 160.

The idle exhaust passage 134 also includes (see FIG. 12) a right outer chamber 166 which communicates with the inner chamber 136 via an opening 168 in the right inner wall 112 and which communicates with the atmosphere via an opening 170 in the right side wall 72. The right outer chamber 166 is defined by the inner wall 112, by the front wall 68 and by the side wall 72. The right outer chamber 166 has therein a transverse wall segment 172 which is located between the openings 168 and 170, which extends between the inner wall 112 and the side wall 72 and which terminates above the lower end of the right outer chamber 166. Gases flowing from the opening 168 to the opening 170 must flow downwardly around the lower end of the transverse wall segment 172 and then upwardly to the opening 170.

The relief means operates as follows. When the engine 26 is operating at idle or low speeds, exhaust gases entering the main exhaust passage 82 flow through the openings 138 and 140, through the tubes 144 and 150, and into the inner chamber 136. This is shown by the arrows in FIGS. 9 and 13. From the inner chamber 136, exhaust gases flow through either of the openings 158, and 168. FIG. 13 shows gases flowing through the opening 158 and FIG. 9 shows gases flowing through the opening 168. From the right opening 158, gases flow into the right outer chamber 156, down around the lower end of the transverse wall segment 162 and then out the opening 160 into the chamber 66. This is shown in FIG. 14. From the left opening 168, exhaust gases flow into the left outer chamber 166, down around the transverse wall segment 172 and then out the opening 170 into the chamber 66. From the chamber 66, exhaust gases flow through the apertures 130 and 132 (as indicated by the arrow in FIG. 15) to the idle exhaust inlet ports 40 and 41. From the inlet ports 40 and 41, exhaust gases flow through the passages 48 and 49 and through the ports 34 and 35 to the atmosphere. This is shown by the arrows in FIG. 6.

The marine propulsion device 10 further comprises means for sandwiching the exhaust housing flange portion 76 between the upper end of the drive shaft housing 52 and the lower face 36 of the engine 26. While various suitable sandwiching means can be employed, in the preferred embodiment, the sandwiching means includes (see FIGS. 1, 7 and 8) a plurality of bolts 180 extending upwardly from the drive shaft housing 52, through the flange portion 76 of the exhaust housing 64 and into the engine block 28.

The arrangement for pivotally mounting the propulsion unit 22 on the swivel bracket 18 is identical to the arrangement described in the above-mentioned, Breckenfeld et al. U.S. Pat. No. 4,979,918 issued Dec. 25, 1990, which is incorporated herein by reference. Thus, the marine propulsion device 10 includes a kingpin 200 (FIGS. 1 and 4) which extends into a bore (not shown) in the swivel bracket 18 and which, at its upper and lower ends, is secured to the propulsion unit 22 by suitable vibration isolation means. More specifically, at the upper end of the kingpin 200, a pair of arms or bolts 204 (see FIG. 4) extend rearwardly and are respectively connected to a pair of resilient or rubber mounts 206 which, in turn, are suitably secured to the propulsion unit 22 so to both vibrationally isolate the propulsion unit 22 from the mounting assembly 12 while, at the same time, supporting the propulsion unit 22 from the mounting assembly 12.

The rubber mounts 206 are generally identical and each includes a cylindrical central core 208 which can be fabricated from metal and has a central bore 210, and a cylindrical outer shell 212 which can also be fabricated from metal. Both the core 208 and the shell 212 are bonded to an intervening elastomeric member 214. The central cores 208 are respectively fixedly assembled onto the extending arms 204 of the kingpin 200 and the outer shells 212 are suitably secured to the propulsion unit 22.

In the disclosed construction, the arrangement for vibrationally isolating and supporting the propulsion unit 22 from the mounting assembly 12 includes the provision of a cavity 216 formed in the front face 32 of the engine block 28. Preferably, the cavity 216, which is located entirely above the lower face 36 of the engine block 28, is formed during casting of the engine block 28. An opening 218 communicates with the cavity 216 and affords entry of at least one rubber mount 206 into the cavity 216. The arrangement for mounting the propulsion unit 22 also includes means which is insertable through the opening 218 and into the cavity 216, which is securable to the engine block 28, and which is engageable with the rubber mounts 206 for fixedly securing the rubber mounts 206 to the engine block 28 and between the insertable means and the interior wall of the cavity 216, so that the rubber mounts 206 are located entirely above the lower face 36 of the engine block 28.

The internal cavity 216 includes spaced side walls 220 which preferably are semi-cylindrical and which are laterally spaced apart at a distance greater than twice the diameter of the outer shells 212. The cavity also includes a rear wall 222, a forward wall 224 (which defines the front face 32 of the engine block 28), and intermediate shoulders 226 respectively projecting inwardly of the cavity 216 from the side walls 220 at a distance from the front wall 224 approximately equal to the axial length of the outer shells 212.

The arrangement for securing the rubber mounts 206 to the engine block 28 also includes the provision of the access or entry opening 218 through the front wall 224 from the exterior of the engine block 28 and into the internal cavity 216 for the purpose of permitting insertion through the opening 218 of the rubber mounts 206 into the internal cavity 216. In this regard, the opening 218 has a lateral dimension which is greater than the diameter of the outer shells 212 but less than the distance or dimension between the side walls 220 of the cavity 216, thereby forming the front wall 224 with a lip, or flange, or shoulder 228 extending from the forward end of the semi-cylindrical side walls 220 of the internal cavity 216.

The opening 218 also has a vertical extent greater than the diameter of the outer shells 212, whereby the rubber mounts 206 can be inserted through the opening 218 and into the cavity 216, with the outer shells 212 of the rubber mounts 206 being thereafter respectively located in nested, snug engagement with the semi-cylindrical side walls 220 and between the shoulders 226 and the lip or flange or shoulder 228 at the front of the cavity 216. In this position, the outer shells 212 are engaged by the cavity 216 to prevent relative movement therebetween.

The arrangement for securing the rubber mounts 206 to the engine block 28 also includes means for tightly securing the rubber mounts 206 in fixed relation with the engine block 28. Such means is disclosed in the above-incorporated Breckenfeld et al. application. Thus, the rubber mounts 206 are directly connected solely to the engine block 28 and are directly fixed to the engine block 28. In other words, the rubber mounts 206 are not directly connected to or fixed to the drive shaft housing 52 or the exhaust housing 64.

Various features of the invention are set forth in the following claims.

I claim:

1. A marine propulsion device comprising an internal combustion engine including an engine block having therein a water jacket and having a lower face which includes therein an exhaust gas outlet port and a recess, a drive shaft housing connected to said lower face of said engine block, a propeller shaft rotatably supported by said drive shaft housing and adapted to support a propeller, a drive shaft extending through said drive shaft housing and including an upper end driven by said engine and a lower end drivingly connected to said propeller shaft, an exhaust housing located at least partially within said drive shaft housing and including an exhaust passage communicating with said exhaust gas outlet port, and an upper face mating with said lower face of said engine block and including therein a recess located in opposed relation to said recess in said lower face, a water passage extending in and defined by said recess in said lower face of said engine block and by said recess in said upper face of said exhaust housing, said water passage having an inlet located in said recess in said upper face, and an outlet located in said recess in said lower face, spaced horizontally from said inlet, and communicating with said water jacket, said water passage extending in adjacent heat exchanging relation to said exhaust gas outlet port, and means connected to said inlet for supplying water to said inlet.

2. A marine propulsion device as set forth in claim 1 wherein said engine block has a forward end and a rearward end, and wherein said outlet is located rearwardly of said inlet 3. A marine propulsion device as set forth in claim 1 wherein said lower face of said engine block has a forward end and a rearward end and also has therein an exhaust outlet, wherein said inlet is located forwardly of said exhaust outlet, and wherein said outlet is located rearwardly of said exhaust outlet.

4. A marine propulsion device comprising an internal combustion engine including an engine block comprising a cylinder, a first water jacket, a water jacket outlet port communicating with said first water jacket, and a lower face having therein an exhaust outlet port communicating with said cylinder, a drive shaft housing, a propeller shaft rotatably supported by said drive shaft housing and adapted to support a propeller, a drive shaft extending through said drive shaft housing and including an upper end driven by said engine and a lower end drivingly connected to said propeller shaft, and an exhaust housing located at least partially within said drive shaft housing so that said exhaust housing and said drive shaft housing define therebetween a second water jacket, said exhaust housing including an exhaust passage communicating with said exhaust outlet port, an upper end, a flange portion located adjacent said upper end, a first passageway extending through said flange portion and communicating with said water jacket outlet port, and a second passageway having an inlet communicating with said first passageway, and an outlet communicating with said second water jacket and extending substantially horizontally between said inlet and said outlet.

5. A marine propulsion device as set forth in claim 4 wherein said exhaust housing also includes a forward wall, and wherein said outlet of said second passageway opens through said forward wall.

6. A marine propulsion device as set forth in claim 4 wherein said drive shaft housing has an upper end, and wherein said marine propulsion device further comprises means for sandwiching said flange portion between said upper end of said drive shaft housing and said engine block.

7. A marine propulsion device comprising an internal combustion engine including an engine block having therein a water jacket and having a lower face, a drive shaft housing connected to said lower face of said engine block, a propeller shaft rotatably supported by said drive shaft housing and adapted to support a propeller, a drive shaft extending through said drive shaft housing and including an upper end driven by said engine and a lower end drivingly connected to said propeller shaft, an exhaust housing located at least partially within said drive shaft housing and including an upper face mating with said lower face of said engine block, a recess located in one of said lower face of said engine block and said upper face of said exhaust housing, a water passage extending in said recess and defined by said recess and by the other of said lower face of said engine block and said upper face of said exhaust housing, said water passage having an inlet in one of said upper face and said recess, and an outlet which is located in one of said lower face and said recess, which is spaced horizontally from said inlet, and which communicates with said water jacket, and means connected to said inlet for supplying water to said inlet.

* * * * *